US011542805B2

(12) United States Patent
Marshall et al.

(10) Patent No.: US 11,542,805 B2
(45) Date of Patent: Jan. 3, 2023

(54) MARKING AND SENSING A BOREHOLE WALL

(71) Applicant: Novatek IP, LLC, Provo, UT (US)

(72) Inventors: Jonathan D. Marshall, Springville, UT (US); David C. Hoyle, Salt Lake City, UT (US); Scott Richard Woolston, Spanish Fork, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/898,491

(22) Filed: Jun. 11, 2020

(65) Prior Publication Data

US 2020/0392829 A1 Dec. 17, 2020

Related U.S. Application Data

(60) Provisional application No. 62/993,744, filed on Mar. 24, 2020, provisional application No. 62/862,121, filed on Jun. 16, 2019.

(51) Int. Cl.

| | |
|---|---|
| ***E21B 45/00*** | (2006.01) |
| ***E21B 7/28*** | (2006.01) |
| ***E21B 10/32*** | (2006.01) |

(52) U.S. Cl.

CPC ..... *E21B 45/00* (2013.01); *E21B 7/28* (2013.01); *E21B 10/32* (2013.01)

(58) Field of Classification Search

CPC ..... E21B 10/32; E21B 10/322; E21B 47/013; E21B 45/00; E21B 47/08; E21B 7/28

See application file for complete search history.

(56) References Cited

U.S. PATENT DOCUMENTS

| | | | | |
|---|---|---|---|---|
| 5,419,405 | A * | 5/1995 | Patton | E21B 7/04 175/27 |
| 8,646,520 | B2 * | 2/2014 | Chen | E21B 47/11 166/66.5 |
| 2006/0096785 | A1 * | 5/2006 | Walter | E21B 10/32 175/267 |
| 2009/0120637 | A1 * | 5/2009 | Kirkwood | E21B 47/13 166/254.2 |
| 2017/0114628 | A1 * | 4/2017 | Khalaj Amineh | E21B 47/085 |
| 2018/0196005 | A1 * | 7/2018 | Fanini | E21B 47/007 |
| 2018/0266186 | A1 * | 9/2018 | Burca | E21B 10/46 |
| 2019/0339411 | A1 * | 11/2019 | Dollfus | G01V 1/50 |
| 2020/0340354 | A1 * | 10/2020 | Westerwaal Gheorghe | G01V 5/08 |
| 2021/0301641 | A1 * | 9/2021 | Dunbar | E21B 45/00 |

* cited by examiner

*Primary Examiner* — Caroline N Butcher

(57) ABSTRACT

A downhole drilling apparatus, passing through a subterranean borehole, may mark an inner wall of the borehole with a marking element. A sensor, spaced axially from the marking element on the drilling apparatus, may subsequently sense the marking as it passes. A rate of penetration of the drilling apparatus may be calculated by dividing an axial distance, between the marking element and the sensor, by a time interval, between when the marking element marks the inner wall and when the marking is sensed by the sensor. Alternately, a second sensor, spaced axially from the first, may also sense the marking. A rate of penetration may then be calculated by dividing an axial distance, between the two sensors, by a time interval, between when the two sensors sense the marking.

19 Claims, 9 Drawing Sheets

MARKING AND SENSING A BOREHOLE WALL

CROSS REFERENCE TO RELATED APPLICATIONS

This patent claims priority to and the benefit of U.S. Provisional Patent Application No. 62/862,121, filed on Jun. 16, 2019, and U.S. Provisional Patent Application No. 62/993,744, filed on Mar. 24, 2020, both of which are incorporated herein by reference in their entireties.

BACKGROUND

When exploring for or extracting subterranean resources, such as oil, gas, or geothermal energy, and in similar endeavors, it is common to form boreholes in the earth. Such boreholes may be formed by engaging the earth with a rotating drill bit capable of degrading tough materials. As rotation continues the borehole may elongate and the drill bit may be fed into it on the end of a drill string.

It is often desirable to measure the rate at which the drill bit is penetrating the various earthen formations that it encounters. This rate of penetration (ROP), as it is called, affects how long it may take to form a borehole and thus its cost. Optimizing rate of penetration to reduce time and cost is thus a concern for many drillers. ROP may also be used to calculate dogleg severity (DLS) of a borehole, e.g., while steering a bit. The DLS is a measure of the change in direction of a borehole over a defined length, e.g., degrees per 100 feet.

Measuring rate of penetration has traditionally been accomplished by monitoring how quickly the drill string is fed into the borehole at its opening. As the borehole elongates, however, the reliability and accuracy of this surface-based method may decrease. This could be due to the increased bending, twisting, stretching, or buckling a drill string may experience at greater lengths. Such distortion may cause the rate of penetration of the drill bit to vary materially from the feed rate of the drill string into the borehole at the surface.

BRIEF DESCRIPTION

A drilling apparatus may be able to measure its own rate of penetration as it passes through a borehole formed within an earthen formation. The borehole may be formed by rotating a drill bit about an axis as described previously. The drilling apparatus may take the form of this drill bit, secured to an end of a drill string, or a drill sub, inserted along a length of the string.

The drilling apparatus may include a marking element spaced axially along the apparatus from a sensor. While passing through the borehole the marking element may mark an inner wall thereof. As the apparatus continues to travel, the sensor may eventually pass the same spot and sense the markings caused by the marking element. The drilling apparatus' rate of penetration may then be calculated by dividing an axial distance, between the marking element and the sensor, by a time interval, between when the marking element marks the inner wall and when the marking is sensed by the sensor. In some embodiments, this calculation may be performed by a processor housed within the drilling apparatus itself or, in other situations, by tools disposed at other points along the drill sting or outside of the borehole.

In some embodiments, the drilling apparatus may include a second sensor, also capable of sensing the markings on the inner wall, spaced axially from the first sensor. In such scenarios, after the first sensor has sensed the markings the drilling apparatus may travel axially until the second sensor senses the same markings. Once this occurs, a rate of penetration may be calculated by dividing an axial distance, between the first sensor and the second sensor, by a time interval, between when the marking is sensed by the first sensor and when the marking is sensed by the second sensor.

In some embodiments, the marking may be accomplished by extending a cutter radially from a side of the drilling apparatus and engaging a section of the inner wall therewith as the apparatus is rotated. Extension and retraction of this cutter may be timed with rotation of the drilling apparatus to create a recognizable pattern on the inner wall of the borehole. Sections of this pattern may later be recognized by one or more sensors as described previously. In some embodiments, the extendable cutter may be repeatedly extended for at least one full rotation of the drilling apparatus while it moves axially to create a subterranean borehole with an inner wall including markings spaced over an axial dimension of the borehole. In some embodiments, the extendable cutter may be repeatedly extended for only part of a rotation of the drilling apparatus to create a subterranean borehole with an inner wall including an increased radius on only a portion of a circumference of the inner wall. This portion of circumference may vary in magnitude over an axial dimension of the borehole. In some embodiments, the extendable cutter may be extended varying distances to create a subterranean borehole with an inner wall of varying radii.

DRAWINGS

FIGS. 3-1 through 3-3 are orthogonal views of an embodiment of a drilling apparatus shown in various positions while forming a borehole.

FIGS. 8-1, 8-2, 8-3, and 8-4 are perspective cutaway views of embodiments of different borehole sections.

Figure 9:
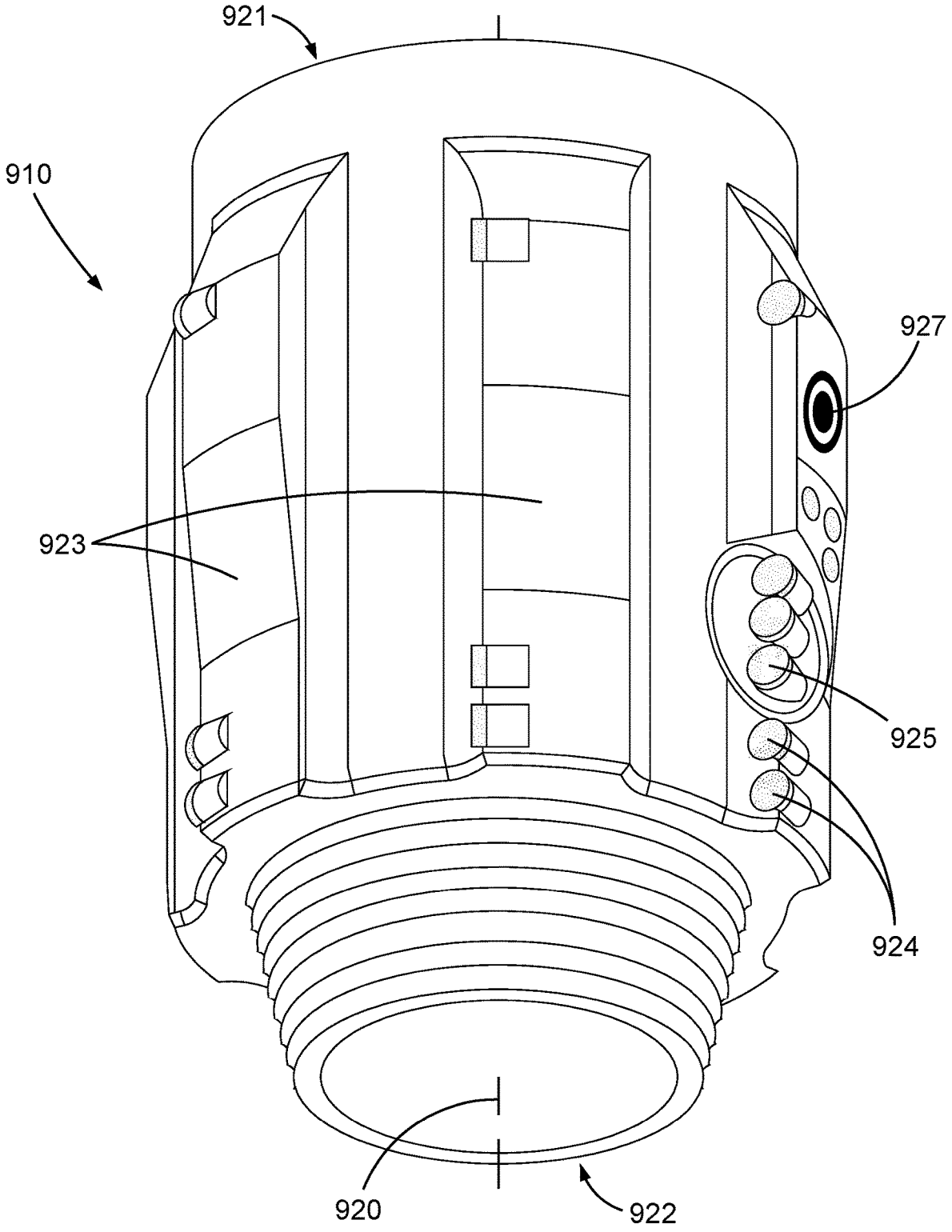

FIG. 9 is a perspective view of an embodiment of a drilling apparatus, in the form of a drill sub.

Figure 10:
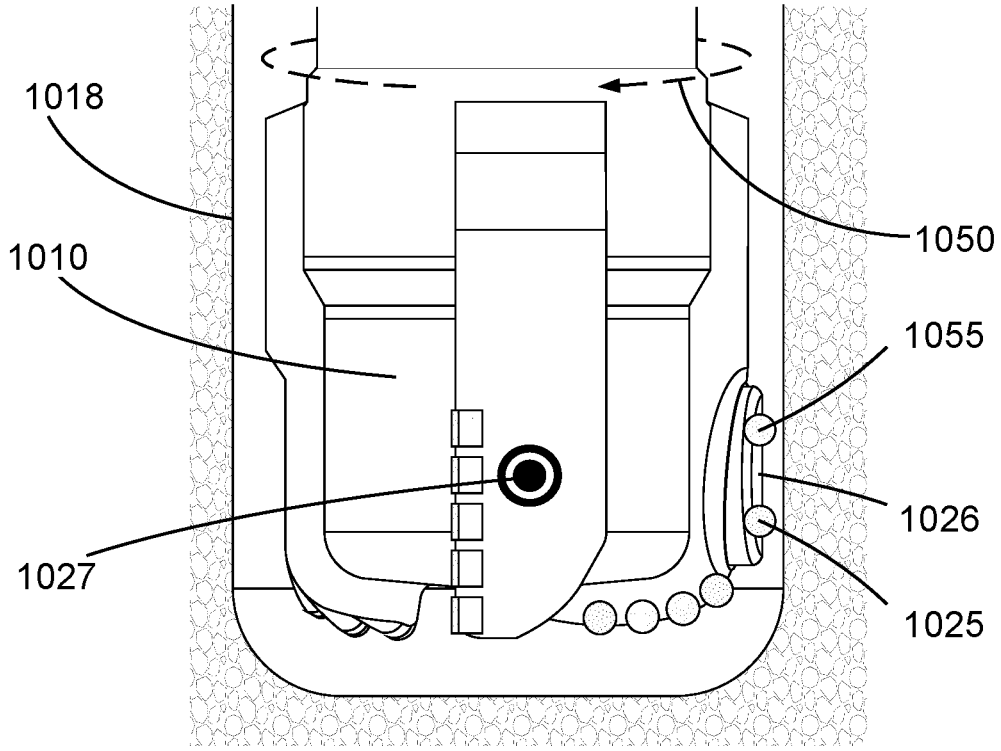

FIG. 10 is another orthogonal view of an embodiment of a drilling apparatus.

DETAILED DESCRIPTION

Figure 1:
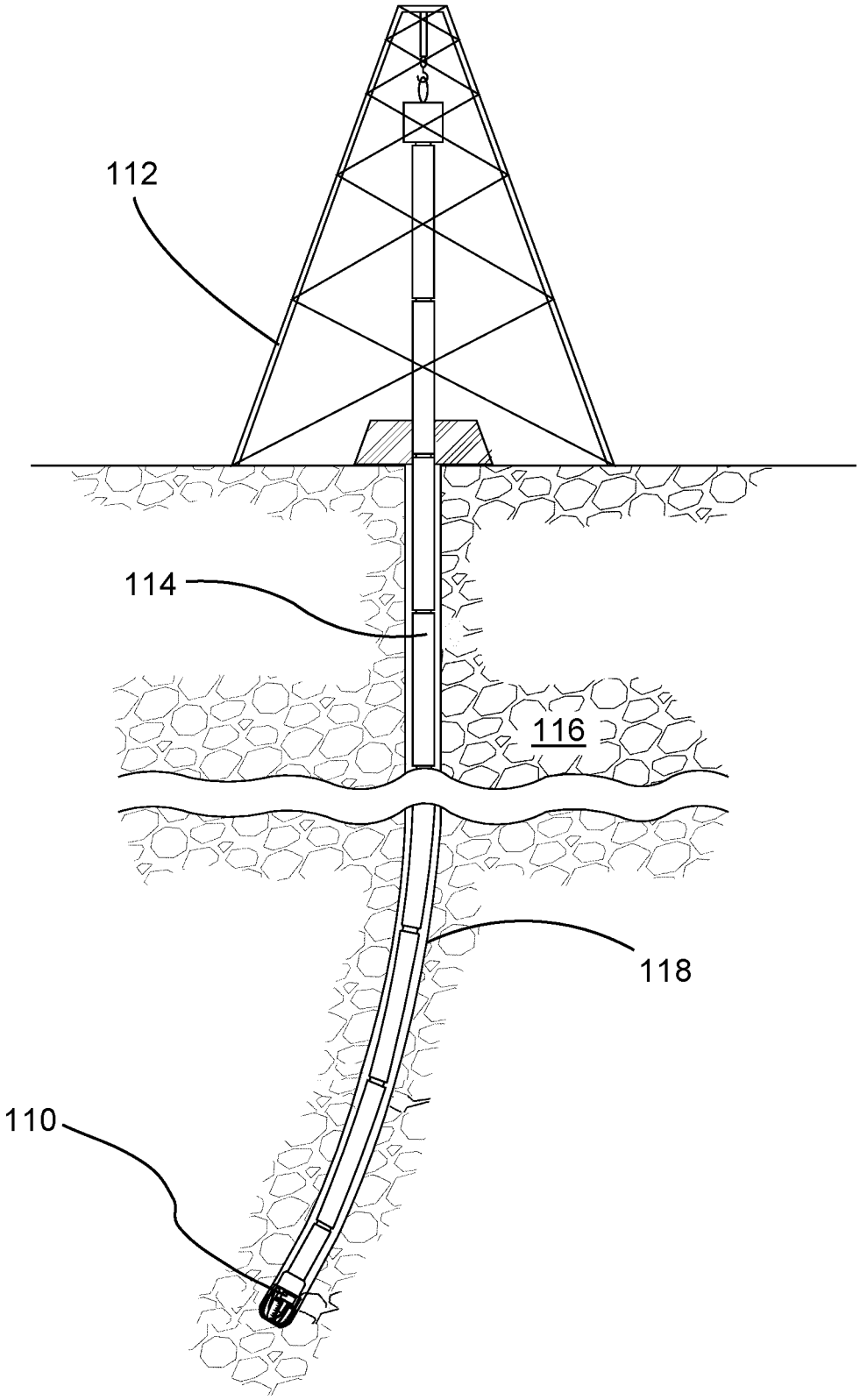
FIG. 1 is an orthogonal view of an embodiment of a subterranean drilling operation.

FIG. 1 shows an embodiment of a subterranean drilling operation of the type commonly used to form boreholes in the earth. As part of this drilling operation, a drilling apparatus 110 may be suspended from a derrick 112 by a drill string 114. In this embodiment, the drilling apparatus 110 takes the form of a drill bit, disposed on a distal end of the drill string 114, that may degrade a subterranean formation 116 as it is rotated. In alternate embodiments, however, drilling apparatuses as described herein may be disposed at various positions along a drill string. Both drilling apparatus 110 and drill string 114 may be fed into a borehole 118 formed by degradation of the formation 116. While a land-based derrick 112 is depicted, comparable water-based structures are also common.

Figure 2:
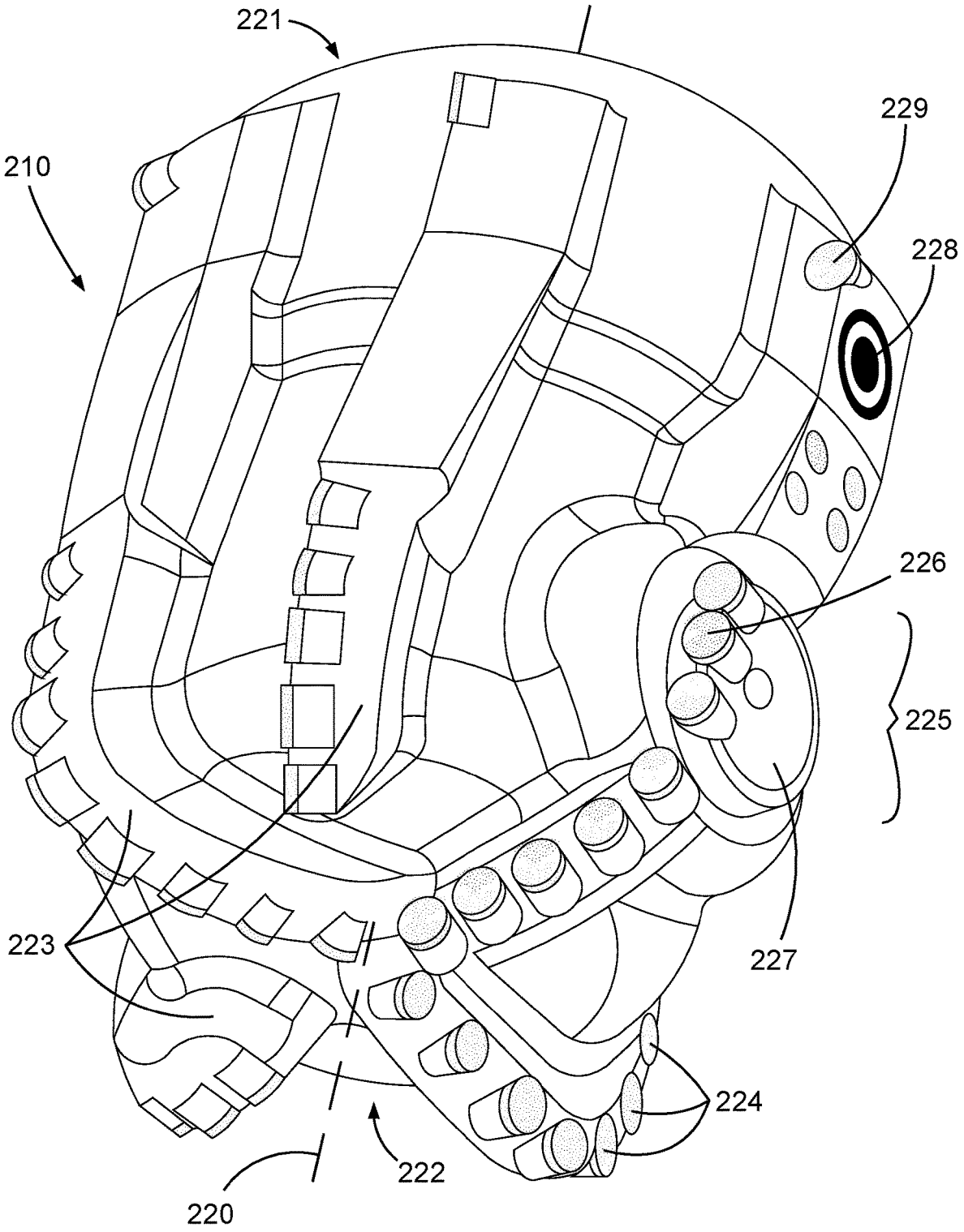
FIG. 2 is a perspective view of an embodiment of a drilling apparatus.

FIG. 2 shows an embodiment of a downhole drilling apparatus 210 that may form part of a subterranean drilling operation as just described. In some embodiments, the drilling apparatus 210 takes the form of a drill bit, rotatable about an axis 220 passing longitudinally therethrough. As such, the drilling apparatus 210 may have two axially-opposing ends, a proximal end 221 securable to a drill string (not shown) and a distal end 222 including a plurality of blades 223 projecting both axially and radially therefrom. These blades 223 may be spaced circumferentially about the axis 220 and include a plurality of fixed cutters 224 (or fixed cutting elements) fastened to each such that they protrude from leading edges thereof. The fixed cutters 224 may be formed of sufficiently tough materials to allow them to engage and degrade a subterranean formation when the drilling apparatus 210 is rotated. Due to their static positioning relative to the axis 220, this degradation by the fixed cutters 224 may form a generally cylindrical borehole through the formation.

The drilling apparatus 210 may also include at least one marking element 225 capable of marking an inner wall of the borehole. In some embodiments, as shown, this marking element 225 is at least one radially extendable cutter 226. However, any number of other mechanisms capable of producing a mark on the inner wall could be used as a marking element, such as a laser, fluid jet or ink jet. This extendable cutter 226 may be selectively extended from a side of the drilling apparatus 210 to engage and degrade specific portions of the inner wall (e.g., it may degrade the borehole wall during a portion of a rotation). In the embodiment shown, this extendable cutter 226 is fixed to an exposed end of a translatable piston 227 that may translate in and out via hydraulic pressure. This piston 227 and extendable cutter 226 may be aligned with one of the blades 223 such that downhole fluids, commonly used in drilling operations, may flow freely there past. However, blade count and spacing can differ.

The drilling apparatus 210 may further include at least one sensor 228 housed thereon. In some embodiments, as shown, this sensor 228 is exposed on an exterior surface of the drilling apparatus 210, however, internally housed versions are also anticipated. The sensor 228 may be spaced at some axial distance from the marking element 225 and capable of recognizing marking of the inner wall of the borehole caused by the marking element 225; in this case, degradation caused by the extendable cutter 226.

At least one trimming cutter 229 may also be fixed to an exterior of the drilling apparatus 210 such that it protrudes radially therefrom, farther than the extendable cutter 226 is capable at its maximum. In this position, the trimming cutter 229 may eliminate markings from the inner wall of the borehole and return the borehole to a generally cylindrical shape.

Figures 1, 3:
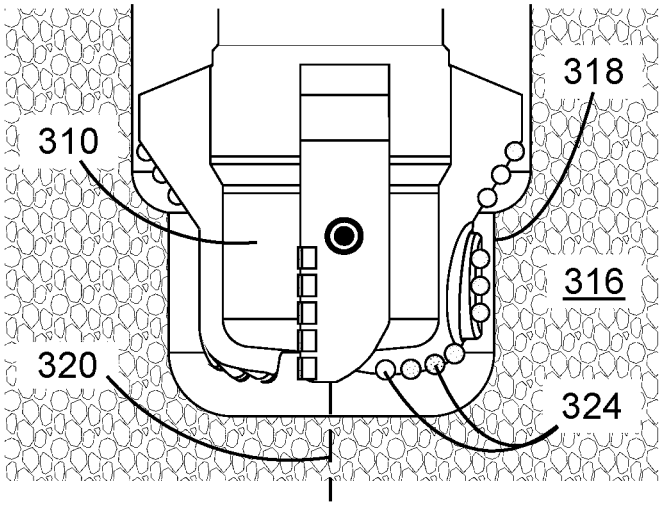
Figures 2, 3:
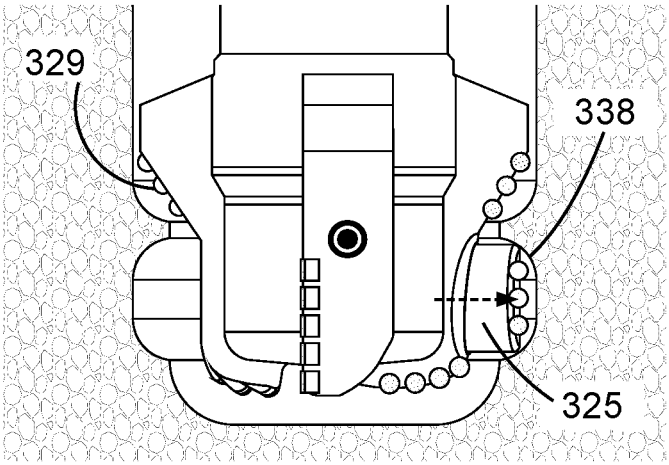
Figure 3:
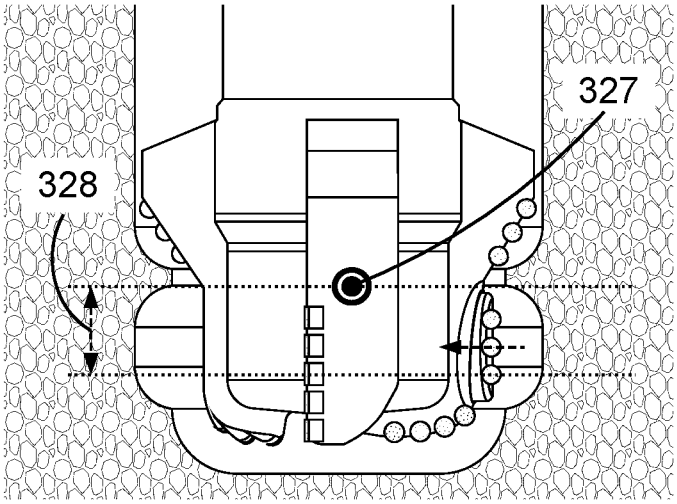

FIGS. 3-1 through 3-3 show another embodiment of a downhole drilling apparatus 310 taking the form of a drill bit. As this drill bit rotates about a rotational axis 320 thereof, fixed cutters 324 protruding therefrom may degrade an earthen formation 316 to create a borehole 318 therein. As shown in FIG. 3-2, a marking element 325, including extendable cutters secured thereto, may be thrust radially outward from a side of the drilling apparatus 310. When thus extended, the marking element 325 may mark a portion 338 of an inner wall of the borehole 318 by engaging and degrading a section thereof. As the borehole 318 is lengthened by rotation of the drilling apparatus 310, and the drilling apparatus 310 is fed into it, a sensor 327 disposed thereon may eventually align axially with the marked portion 338, as shown in FIG. 3-3. When this occurs, a rate of penetration of the drilling apparatus 310 through the formation 316 may be calculated. The rate of penetration of the drilling apparatus 310 may be calculated by dividing a fixed axial distance 328, between the marking element 325 and the sensor 327, by the time elapsed, between when the marking element 325 marked the portion 338 of the inner wall and when the marking was sensed by the sensor 327.

Figure 4:
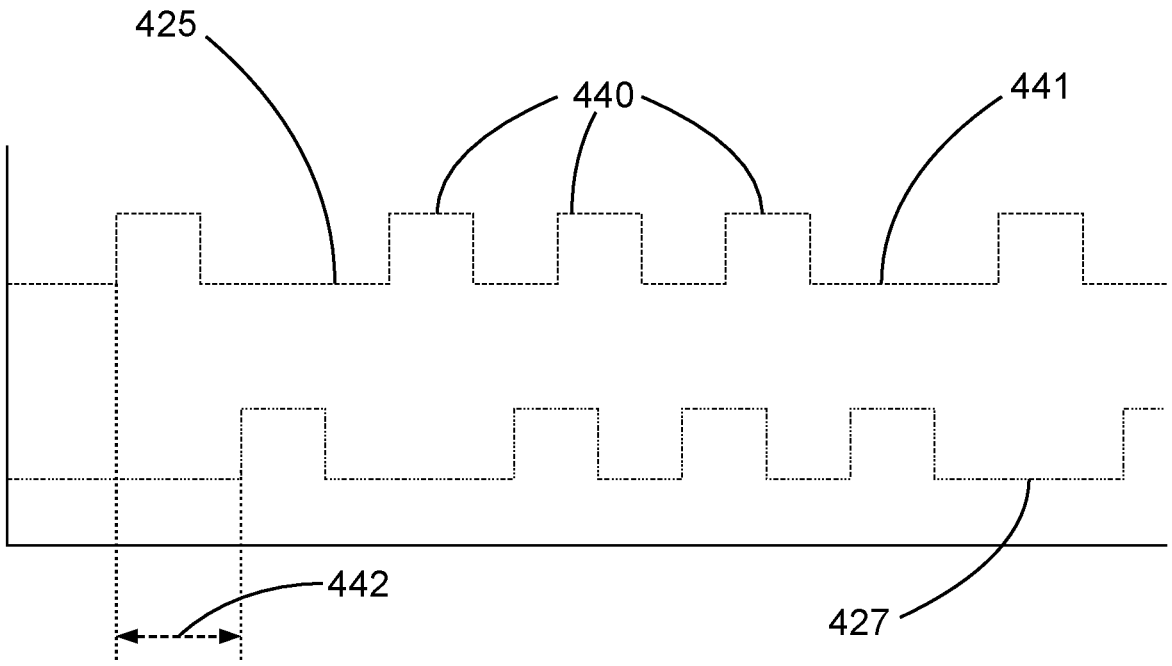
FIG. 4 is a graphical representation of an embodiment of a time lapse between when a marking element marks an inner wall of a borehole and when a sensor senses the marking.

FIG. 4 represents a marking 425 of a portion of an inner wall by a marking element over time. In some embodiments, the marking element may extend outward 440 from a drilling apparatus at certain times and retract inward 441 at other times. A sensor traveling with the marking element but spaced axially therefrom may sense 427 the marking after a specific time delay 442. As described previously, a rate of penetration of a drilling apparatus may be calculated by dividing a fixed distance, between a marking element and a sensor, by this time delay 442, between when the marking element makes a mark and when that mark is sensed.

Figure 5:
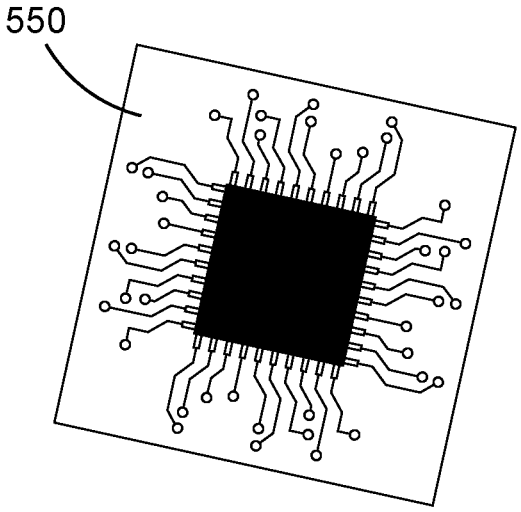
FIG. 5 is an enlarged view of an embodiment of a processor.

FIG. 5 shows an embodiment of a processor 550 of a type that may be housed within a drilling apparatus and capable of determining when an inner wall of a borehole is marked. For example, in one embodiment the processor 550 may be wired to some sort of measuring instrument capable of detecting when a marking element extends from a drilling apparatus. In another embodiment, the processor 550 may control extension of the marking element by, for example, manipulating a valve capable of channeling pressurized hydraulic fluid to the marking element. While in other embodiments, the marking element may be extended at intervals determined by a timing algorithm known to the processor 550 which may predict positioning of the marking element based thereon.

The processor 550 may also be capable of determining when a sensor senses marking on an inner wall of a borehole. For example, in some embodiments an ultrasonic sensor may emit a high-frequency acoustic pulse that may be reflected by an inner wall of a borehole back to the sensor. Degradation of the inner wall may prolong the time required for the high-frequency pulse to make this return trip. In some embodiments, a resistivity sensor, capable of measuring an earthen formation's ability to resist electrical conduction, may identify changes in standoff from the inner wall. Degradation of the inner wall may alter this standoff such that it may be recognizable by the resistivity sensor. In some embodiments, a physical caliper may extend from a side of a drilling apparatus and touch the inner wall, allowing a distance to the inner wall to be measured. In some embodiments, an optical sensor may detect a quantity of light indicating a marking on an inner wall of a borehole. Based on when the inner wall is marked and when the sensor senses the marking the processor 550 may be able to calculate a rate of penetration of the drilling apparatus. While a few example sensors have been described, any suitable sensor for sensing a marking on the borehole wall may be used.

In some embodiments, the drilling apparatus 310 may also include a reamer 329, as shown in FIG. 3-2, capable of degrading tough earthen materials. This reamer 329 may extend farther from a rotational axis 320 of the drilling apparatus 310 than the extendable cutting element 325 when fully extended. This reamer 329 may also be spaced axially from both the extendable cutting element 325 and the sensor 327. In such a configuration, the reamer 329 may clear away degradation from the inner wall of the borehole 318, caused by the extendable cutting element 325, and leave the borehole 318 with a generally cylindrical shape again.

FIG. 10 shows an embodiment of a drilling apparatus 1010 including two radially extendable cutting elements 1025, 1055. Both cutting elements 1025, 1055 may be fixed to an exposed end of a translatable piston 1026 such that hydraulic pressure applied to the piston 1026 may extend them simultaneously. These cutting elements 1025, 1055 may also be spaced axially from each other such that a sensor 1027 may be disposed axially therebetween. With this spacing, the piston 1026 may be controlled to cause a first cutting element 1025 to degrade a borehole 1018 inner wall in some recognizable manner. As the drilling apparatus 1010 proceeds along the borehole 1018, the sensor 1027 may eventually align with and sense this degradation. An internal processor may perform various calculations based on the timing of this degradation and sensation as described previously. After the sensor 1027 has identified the degradation, the piston 1026 may be thrust outward allowing a second cutting element 1055 to clear away degradation from the borehole 1018 inner wall caused by the first cutting element 1025. Thus, the borehole 1018 may be left with a generally cylindrical shape without the need for a reamer as discussed previously.

As well as being disposed axially between the first and second cutting elements 1025, 1055, the sensor 1027 may also be spaced circumferentially apart therefrom. Specifically, in the embodiment shown, if the drilling apparatus 1010 is rotated about an axis thereof, in a direction represented by arrow 1050, then the sensor 1027 may be positioned just in front of the first and second cutting elements 1025, 1055. In this position, the drilling apparatus 1010 may have nearly a full rotation to move axially through the borehole 1018 before the sensor 1027 needs to detect degradation from the first cutting element 1025. It is believed that, in certain circumstances, increasing the time allotted for the drilling apparatus 1010 to penetrate axially before the sensor 1027 needs to perform its functions may increase accuracy of rate of penetration calculations.

Figure 6:
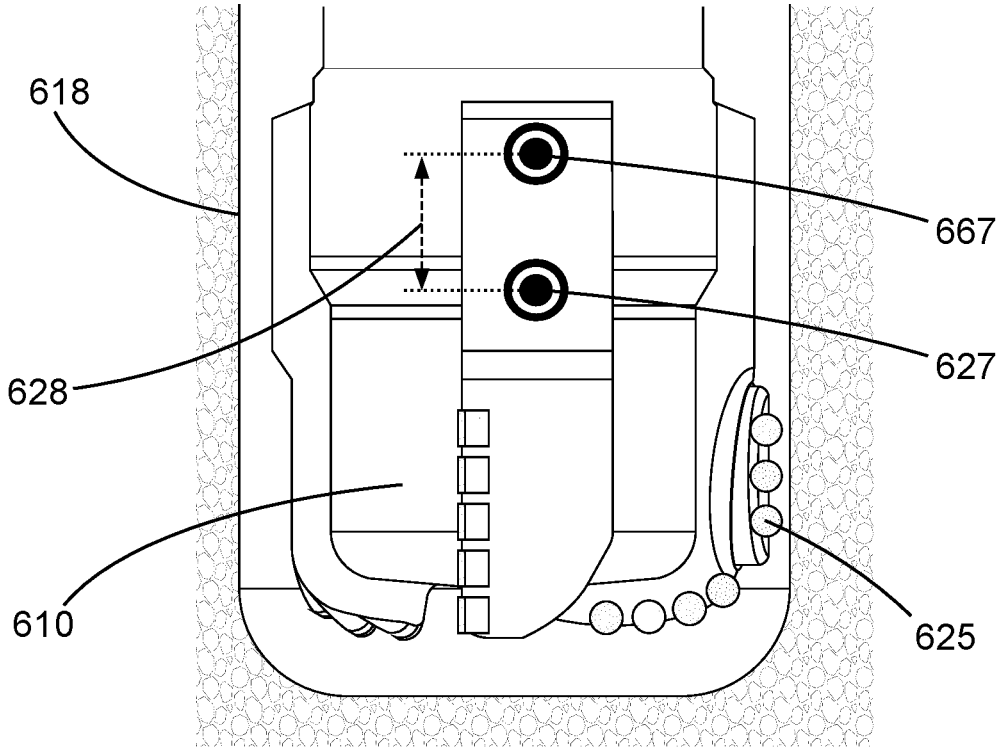
FIG. 6 is another orthogonal view of an embodiment of a drilling apparatus.

FIG. 6 shows another embodiment of a drilling apparatus 610 including two axially spaced sensors 627, 667. A marking element 625 (e.g., an extendable cutting element) may be extended from a side of the drilling apparatus 610 and mark an inner wall of a borehole 618. As the drilling apparatus 610 translates axially through the borehole 618, a first sensor 627 may eventually align with the marking and indicate the timing of this event to an internal processor. As the drilling apparatus 610 translates further, a second sensor 667 may align with the marking and indicate the timing of this subsequent event to the processor. Measurements stemming from these two sensors 627, 667 may share similarities with those shown in FIG. 4 and a rate of penetration may be calculated based thereon in a similar fashion. For example, the processor may be able to calculate a rate of penetration of the drilling apparatus 610 by dividing a fixed axial distance 628, between the first sensor 627 and the second sensor 667, by the time elapsed, between when the degradation was sensed by the first sensor 627 and when the degradation was sensed by the second sensor 667. In some embodiments, this multi-sensor method for measuring rate of penetration may have several advantages. For example, the processor may not need to know when the marking occurred. The processor may thus be completely disconnected and remote from the extendable cutting element 625. Additionally, the extension of the marking element 625 may be based on other concerns, such as steering a drill bit or reaming a borehole, rather than controlled for the sake of the rate of penetration measurement.

Figure 7:
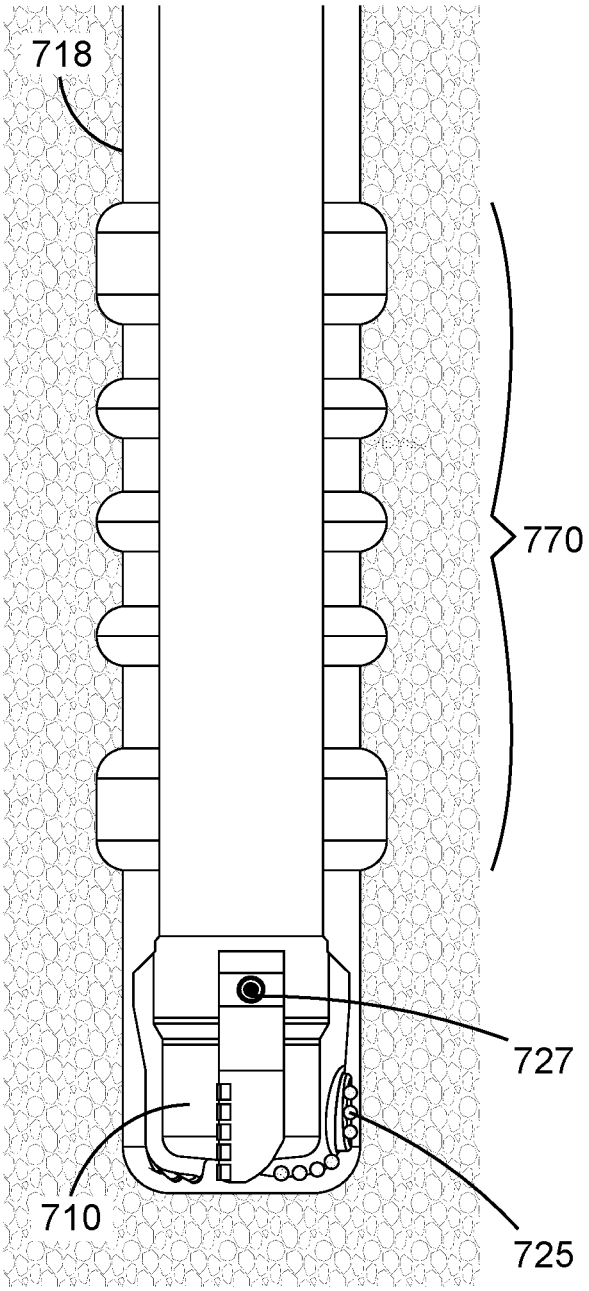
FIG. 7 is an orthogonal view of an embodiment of a drilling apparatus forming a section of a borehole.
Figures 2, 8:
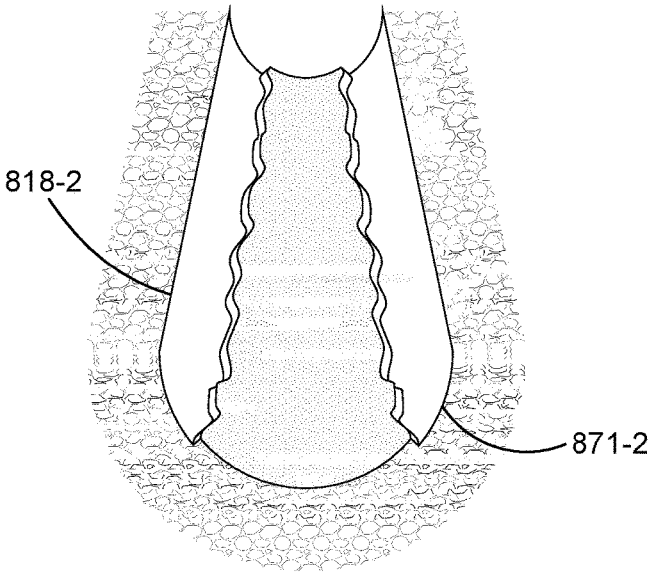
Figures 4, 8:
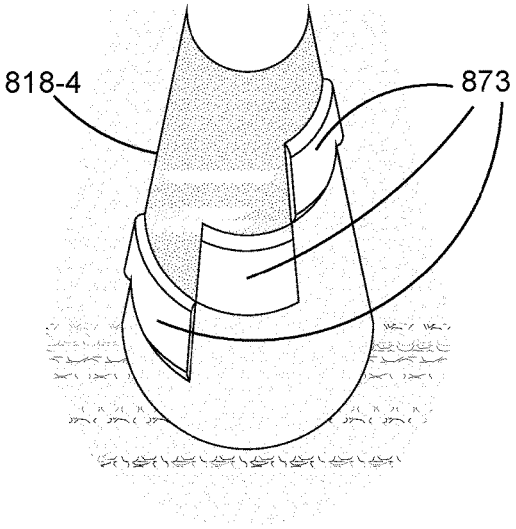
Figures 3, 8:
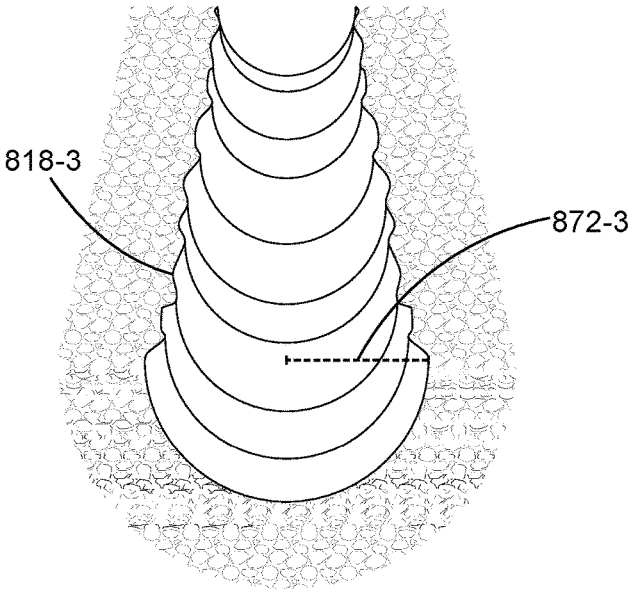

In FIG. 7, an embodiment of a drilling apparatus 710 is shown forming a section of a borehole 718. While doing so, a cutting element 725 has been radially extended therefrom at different times to create a recognizable pattern 770 along an inner wall of the borehole 718. As a sensor 727, traveling with the drilling apparatus 710, reaches this pattern 770 and passes its detection on to an internal processor, the processor may recognize the pattern 770 and perform various actions based thereon.

Figures 1, 8:
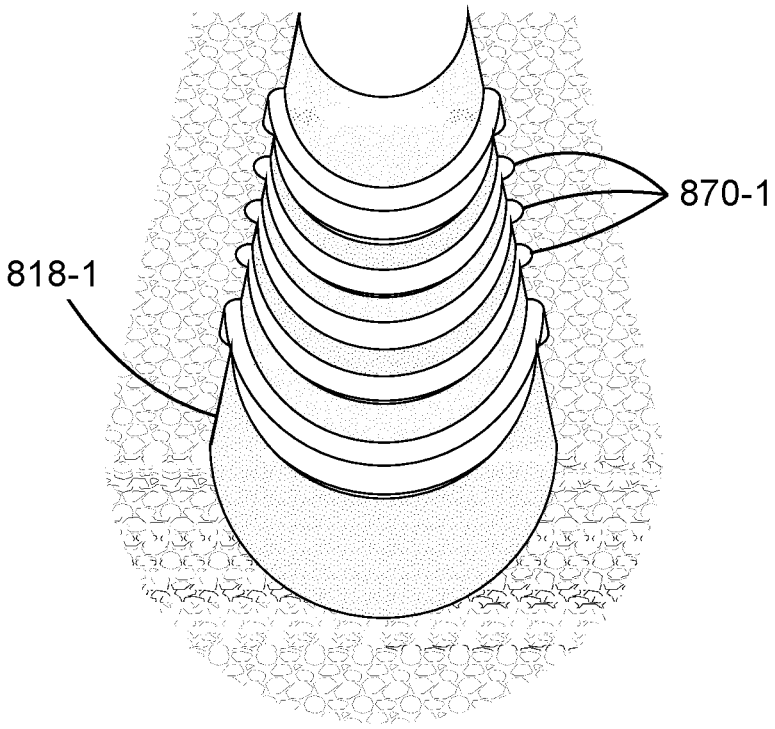

FIGS. 8-1, 8-2, 8-3, and 8-4 show embodiments of marked borehole sections. For example, FIG. 8-1 shows a borehole 818-1 that could be formed by a rotating drilling apparatus as it passes through an earthen formation. An inner wall of the borehole 818-1 has been marked by a marking element repeatedly extending and retracting from a side of the drilling apparatus as it rotated. In this embodiment, the marking element has been extended to create a recognizable pattern 870-1 of rings spaced along the inner wall. As a sensor, traveling with the drilling apparatus, reaches this pattern 870-1 of markings and passes its detection on to a processor, the processor may recognize the pattern 870-1 and perform various actions based thereon.

FIG. 8-2 shows another embodiment of a borehole 818-2 formed in a similar manner to that shown in FIG. 8-1 but with a different pattern of marking. In this embodiment, a marking element has been repeatedly extended for only part of a rotation of a drilling apparatus to increase the radius on a portion of a circumference 871-2 of the inner wall. A length of this circumference portion 871-2 may vary in magnitude along an axial dimension of the borehole 818-2. In some embodiments, such a variance of portion length may form a pattern detectable by a sensor and recognizable by a processor. In the embodiment shown, the length of the circumference portion 871-2 varies randomly to aid in steering a drill bit. Even with such random variations, however, changes in this portion length may allow for rate of penetration to be measured.

FIG. 8-3 shows another embodiment of a borehole 818-3. In this embodiment, an extension distance of a marking element has been controlled to vary a cross-sectional radius 872-3 of the borehole 818-3. Such a variance of cross-sectional radius 872-3 may be detectable by a sensor capable of measuring a distance from a drilling apparatus to an inner wall.

FIG. 8-4 shows another embodiment of a borehole 818 formed in a similar manner to that shown in FIGS. 8-1, 8-2, and 8-3 but with a different marking. In this embodiment, extension of a cutting element has been controlled to alter the cross-sectional radius of the borehole 818-4 in various angular portions 873 thereof. Just as before, such angular portions 873 may be sized and spaced to form a pattern detectable by a sensor and recognizable by a processor.

FIG. 9 shows an embodiment of a downhole drilling apparatus 910 taking the form of a drill sub. Just as with the drill bit embodiments discussed thus far, this drill sub embodiment may rotate about an axis 920 passing longitudinally therethrough and include two axially-opposing ends 921, 922. In this embodiment however, the axially-opposing ends 921, 922 may both be securable to sections of drill string such that the drilling apparatus 910 may be positioned anywhere along a length of the string or BHA.

This drilling apparatus 910 may include at least one marking element 925 (e.g., a radially extendable cutting element), selectively extendable from a side thereof. Extension of this marking element 925 may mark portions of an inner wall of a borehole (not shown) through which the drilling apparatus 910 may be passing. At least one sensor 927 may be housed within the drilling apparatus 910 and exposed on its side. Similar to previous embodiments, this sensor 927 may be spaced at some axial distance from the extendable cutting element 925 and capable of recognizing degradation of the inner wall of the borehole.

In the embodiment shown, the drilling apparatus 910 also includes a plurality of blades 923 projecting radially therefrom and spaced circumferentially about the axis 920. A plurality of fixed cutting elements 924 (e.g., cutters) may be fastened to each of these blades 923 such that they protrude from leading edges thereof. These fixed cutting elements 924 may be formed of sufficiently tough materials such that they clear markings from the borehole inner wall. This may allow the sensor 927 to focus on the markings caused by the marking element 925.

The embodiments of a downhole drilling assembly have been primarily described with reference to wellbore drilling operations; the downhole drilling assemblies described herein may be used in applications other than the drilling of a wellbore. In other embodiments, downhole drilling assemblies according to the present disclosure may be used outside a wellbore or other downhole environment used for the exploration or production of natural resources. For instance, downhole drilling assemblies of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

The invention claimed is:

1. A downhole drilling assembly, comprising:

a drilling apparatus comprising:

a marking element capable of marking an inner wall of a borehole, wherein the marking element comprises a radially extendable cutting element capable of degrading the inner wall of the borehole, and marking the inner wall of the borehole comprises: degrading the inner wall and varying a radius of the borehole by repeatedly extending and retracting the radially extendable cutting element;

a sensor, spaced axially from the marking element, capable of sensing the marking of the inner wall, wherein sensing the marking comprises: identifying changes in standoff from the inner wall, a measuring a distance to the inner wall, or any combination thereof; and a trimming cutter spaced axially from the sensor, wherein the trimming cutter is fixed to an exterior of the drilling apparatus and extends radially farther than the radially extendable cutting element when the radially extendable cutting element is fully extended.

2. The downhole drilling assembly of claim 1, further comprising a processor capable of calculating a rate of penetration.

3. The downhole drilling assembly of claim 1, the drilling apparatus further comprising two radially extendable cutting elements spaced axially from each other and extendable together.

4. The downhole drilling assembly of claim 3, wherein the sensor is disposed axially between the two radially extendable cutting elements.

5. The downhole drilling assembly of claim 1, further comprising a second sensor spaced axially from the sensor, the second sensor capable of sensing the marking of the inner wall.

6. The downhole drilling assembly of claim 1, wherein the sensor comprises at least one of an ultrasonic sensor, a resistivity sensor or a physical caliper.

7. The downhole drilling assembly of claim 1, wherein the sensor is spaced circumferentially from the marking element.

8. A method for downhole drilling, comprising:

forming a borehole by engaging cutting elements of an assembly to degrade a formation, wherein the borehole comprises a cylindrical shape;

marking an inner wall of the borehole with a marking element, wherein marking the inner wall comprises varying a radius of the borehole from the cylindrical shape to form a pattern, wherein the marking element comprises a radially extendable cutting element, and the varying radii of the pattern corresponding to extending and retracting the radially extendable cutting element from the assembly to degrade the inner wall of the borehole, wherein extending and retracting the radially extendable cutting element is timed with rotation of the assembly to form the pattern; and sensing the marking of the inner wall with a sensor spaced axially from the marking element, wherein sensing the marking comprises measuring a distance to the inner wall.

9. The method for downhole drilling of claim 8, further comprising calculating a rate of penetration by: dividing an axial distance, between the radially extendable cutting element and the sensor, by a time interval, between when the radially extendable cutting element marks the inner wall and when the marking is sensed by the sensor.

10. The method for downhole drilling of claim 9, wherein when the radially extendable cutting element marks the inner wall is determined by detecting extension of the radially extendable cutting element.

11. The method for downhole drilling of claim 8, further comprising reaming degradation from the inner wall with a second radially extendable cutting element spaced axially from the radially extendable cutting element.

12. The method for downhole drilling of claim 8, further comprising calculating a rate of penetration by: dividing an axial distance, between the marking element and the sensor, by a time interval, between when the marking element marks the inner wall and when the marking is sensed by the sensor.

13. The method for downhole drilling of claim 8, further comprising:

sensing the marking of the inner wall with a second sensor spaced axially from the sensor; and dividing an axial distance by a time interval, wherein the axial distance is a distance between the sensor and the second sensor, and the time interval is an interval between when the marking is sensed by the sensor and when the marking is sensed by the second sensor.

14. A method for downhole drilling, comprising:

forming a borehole by engaging cutting elements of an assembly to degrade a formation, wherein the borehole comprises a cylindrical shape;

marking an inner wall of the borehole with a marking element, wherein marking the inner wall comprises varying a radius of the borehole from the cylindrical shape to form a pattern by extending a cutting element radially from the assembly to degrade the inner wall of the borehole and retracting the cutting element toward the assembly during a rotation of the assembly, wherein the pattern varies the radius on a portion of a circumference of the inner wall; and sensing the marking of the inner wall with a sensor spaced axially from the marking element, wherein sensing the marking comprises identifying changes in standoff from the cylindrical shape of the inner wall.

15. The method for downhole drilling of claim 14, further comprising calculating a rate of penetration by: dividing an axial distance, between the marking element and the sensor, by a time interval, between when the marking element marks the inner wall and when the marking is sensed by the sensor.

16. The method for downhole drilling of claim 14, wherein the method further comprises calculating a rate of penetration by: dividing an axial distance by a time interval, wherein the axial distance is a distance between the cutting element and the sensor, and the time interval is an interval between when the cutting element marks the inner wall and when the marking is sensed by the sensor.

17. The method for downhole drilling of claim 16, wherein when the cutting element marks the inner wall is determined by detecting extension of the cutting element.

18. The method for downhole drilling of claim 14, wherein sensing the marking of the inner wall comprises sensing the pattern.

19. The downhole drilling assembly of claim 1, wherein the drilling apparatus comprises a drill bit.

* * * * *